United States Patent [19]

Zeller

[11] Patent Number: 4,742,769

[45] Date of Patent: May 10, 1988

[54] PRINTING CYLINDER AND AXIAL GROOVE FILLER COMBINATION

[75] Inventor: Reinhard Zeller, Augsburg, Fed. Rep. of Germany

[73] Assignee: M.A.N. Roland Druckmaschinen Aktiengesellschaft, Offenbach am Main, Fed. Rep. of Germany

[21] Appl. No.: 927,734

[22] Filed: Nov. 5, 1986

[30] Foreign Application Priority Data

Nov. 15, 1985 [DE] Fed. Rep. of Germany ..... 3540581

[51] Int. Cl.[4] ..... B41F 13/08

[52] U.S. Cl. ..... 101/216; 101/375; 101/415.1

[58] Field of Search ..... 101/415.1, 375–378, 101/216

[56] References Cited

U.S. PATENT DOCUMENTS

| | | | |
|---|---|---|---|
| 1,867,861 | 7/1932 | Mollet | 101/376 |
| 1,873,233 | 8/1932 | Wood | 101/378 |
| 1,928,161 | 9/1933 | Wood | 101/378 |
| 2,248,612 | 7/1941 | Crafts | 101/378 |
| 2,320,762 | 6/1943 | Tollison | 101/378 |
| 2,402,706 | 6/1946 | Sprigg | 101/415.1 |
| 2,622,000 | 12/1952 | Thompson | 101/415.1 |
| 3,043,219 | 7/1962 | Dietrich | 101/415.1 |
| 3,196,788 | 7/1965 | Knowles | 101/216 |
| 4,217,824 | 8/1980 | Rebel et al. | 101/415.1 |
| 4,515,375 | 5/1985 | Bleckmann et al. | 101/415.1 |
| 4,552,068 | 11/1985 | Bernauer et al. | 101/415.1 |

*Primary Examiner*—Edgar S. Burr
*Assistant Examiner*—James A. Lisehora
*Attorney, Agent, or Firm*—Frishauf, Holtz, Goodman & Woodward

[57] ABSTRACT

Roll-off shocks of cylinders, typically rubber blanket cylinders with respect to each other, are ameliorated or avoided by inserting a filler element into the groove which is located in the median third of the cylinder, but does not extend over the entire length thereof. The filler element is supported on the bottom of the groove, preferably over a damping or resilient element, and has a dimension which is equal to the outer circumference (44) of the bearer ring or the theoretical pitch circle (45) of a drive gear of the cylinder, with tolerance of not more than about ±0.05 mm. In order to insert the filler elements into the respcective grooves, the cover layers or, if necessary, also the substrate supports of rubber blankets, are removed in the region of the axial length of the filler element. Preferably, the filler elements are made of metal.

28 Claims, 1 Drawing Sheet

Fig. 1
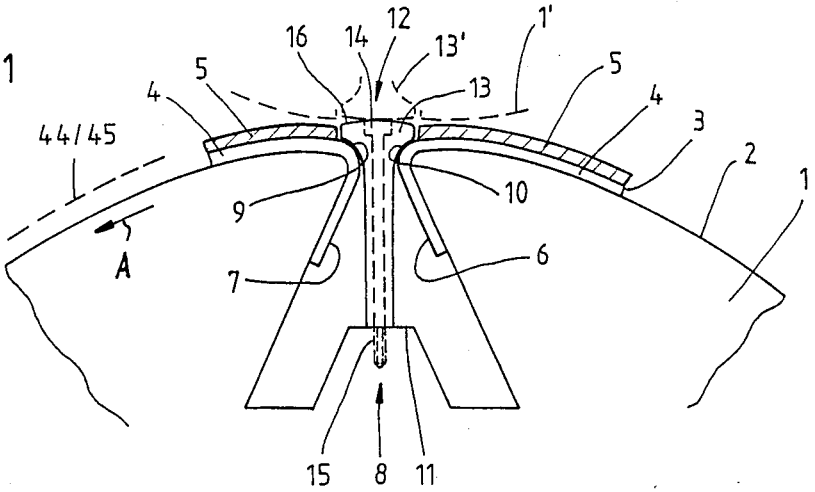
Fig. 2
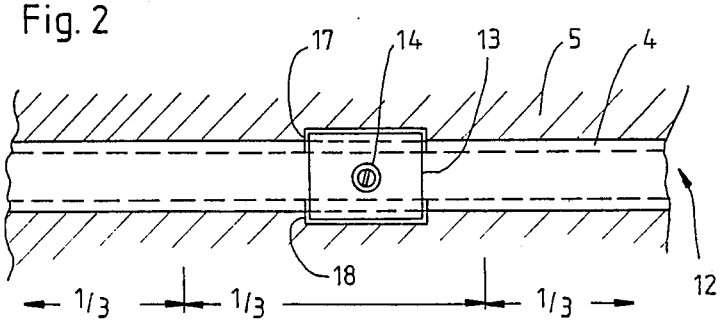
Fig. 3
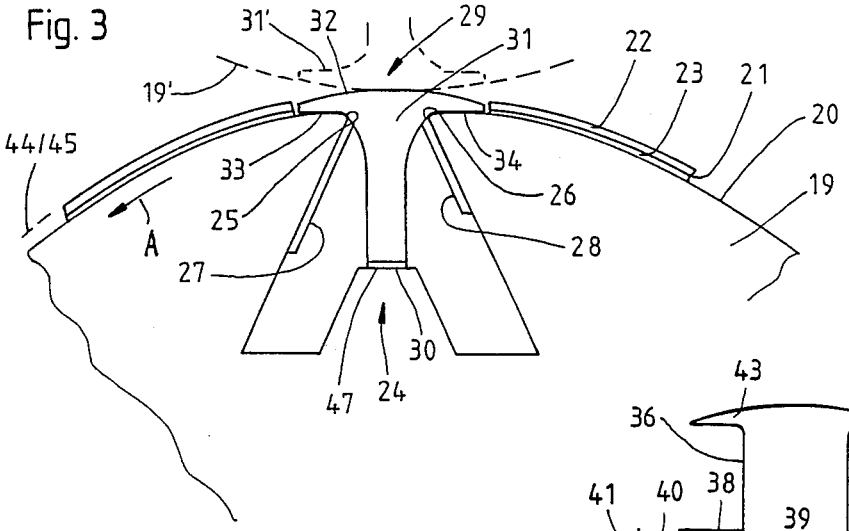
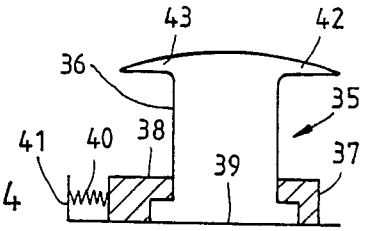
Fig. 4

PRINTING CYLINDER AND AXIAL GROOVE FILLER COMBINATION

The present invention relates to printing machines, and more particularly to printing machine cylinders which have an axial groove, and a filler placed in the axial groove to reduce shocks and vibration when such a printing cylinder rolls off against another printing cylinder.

BACKGROUND

Rotary printing machines which have cylinders with axial grooves are subjects to shocks and vibration. When two cylinder grooves of printing cylinders, for example rubber blanket cylinders of an offset machine run off against each other, a shock or impact results which, on the printed subject matter, may be noticed as a strip of different intensity of inking. This problem arises particularly in modern high-speed rotary printing machines. It has been proposed to cover the cylinder groove—see the referenced U.S. Pat. No. 4,403,549, Matuschke. Other proposals have been made to dampen impacts and shocks which impair the quality of the printed subject matter. Fillers as known heretofore usually extended over the entire length of the cylinder groove. This causes difficulty in handling the machine or machine set-up; in manufacture, also, difficulties arise and such fillers may become expensive, particularly with long cylinders. Some improvement was obtained, although further improvement still is desirable.

THE INVENTION

It is an object to further improve the running smoothness of printing machines, and particularly of printing machines which have bearer rings as well as machines which do not have bearer rings, by damping the roll-off cylinder grooves with respect to each other or eliminating shocks which arise upon roll of cylinder grooves, at least to such an extent that no noticeable effect on the printed subject matter will result.

Briefly, a filler element is provided, located only within the center region, that is, within the center third axial section or zone of the cylinder, the filler element being supported on a base, or root of the cylinder groove. It is, additionally, supported at least on one of the groove edges. The filler element has an outer, part-circular contour which is identical to the contour of the pitch circle of the gear driving the cylinder or, if the cylinder is equipped with a bearer ring, the outer contour of the bearer ring, with a tolerance of ± only 0.05 millimeter. In other words, the radius of curvature of the contour of the filler element is identical to, respectively, the radius of curvature of the bearer ring, or of the pitch circle of the driving gear.

DRAWINGS

FIG. 1 is an axial part-circular section through a portion of a cylinder, illustrating the cylinder groove, and having a filler in accordance with the present invention;

FIG. 2 is a developed, fragmentary top view of the cylinder in the region of the groove;

FIG. 3 is a side view through a cylinder and a groove, in which the regions adjacent the cylinder groove are laterally flattened; and FIG. 4 is a schematic part-sectional axial illustration of a holding arrangement for a filler in a cylinder groove.

DETAILED DESCRIPTION

For purposes of illustration, the invention will be described in connection with a rubber blanket cylinder 1 (FIG. 1) having a cylinder surface or contour 2 on which, as well known, a rubber blanket 3 can be stretched. The rubber blanket 3 is retained in a cylinder groove 8 in any suitable and well known manner. The rubber blanket 3 has a lower carrier surface 4, for example of fabric, and a cover layer 5 thereover which, typically, is rubber. The ends 6, 7 of the blanket 3 are retained by suitable tensioning spindles or clamps located in the axial cylinder groove, for clamping the blanket 3 and stretching it around the circumference 2 of the cylinder. Holding and clamping arrangements have been omitted from the drawing since they can be in accordance with any well known and standard construction and do not form part of the present invention. The blanket 3 is tightened by the customary stretching arrangement over the edges 9, 10 of the groove 8.

In accordance with the present invention, a filler element 13 of lesser axial length than the cylinder which, preferably, is metal, is located in the cylinder groove 8. It can be placed through the groove opening 12 by slipping it into the groove, and retaining it in the groove by any suitable attachment, for example a screw which passes through a bore 14 (FIG. 2) in the element 12 and into a tapped hole 15 in the bottom of the groove 8. Preferably, the filler element 3 should be so dimensioned that it can be supported at least in the region of the opening of the groove 12 on one of the edges of the groove, as shown on the groove edge 10, in order to be able to accept circumferential forces which, under some and unfavorable conditions, may otherwise result in a tendency of the filler element 13 to tip or deflect in the cylinder groove 8, or, respectively, in the opening 12 thereof. The blanket cylinder 1 rotates in the direction of the arrow A. It can be engaged with another blanket cylinder, illustrated in broken lines at 1', in order to provide for prime-and-verso printing upon passage of the substrate between the cylinders 1, 1'.

In accordance with a feature of the invention, the filler 13 does not extend over the entire axial length of the cylinder but, rather, is located in a median position—with respect to the axial length of the cylinder 1—and as seen by the dimension lines, within the center third section or zone of the axial length of the cylinder a suitable length is between about 5 to 10 cm. (about 2–4 inches). In accordance with a feature of the invention, the cover layer 5 of the rubber blanket or the entire rubber blanket is removed adjacent the opening 12 of the groove 8. In accordance with a preferred feature, only the rubber cover is removed. In this region, then, only the support layer or substrate 4, that is, the fabric of the blanket 3, will be placed into the cylinder groove 8, as schematically shown at 17, 18, FIG. 2. The filler 13 preferably is made of metal and, in circumferential direction, has a width which is slightly wider than the width of opening 12 of the groove. In accordance with a feature of the invention, the radial length or, in other words, the height of the filler element 13, is so dimensioned that the circumferential contour 16 of the filler 13 has a tolerance of ±0.05 mm with respect to the circumference of a bearer ring which, as well known, can be placed at an axial end of the cylinder. If the cylinder of the printing machine with which the present invention is to be used does not have bearer rings, then the height or radial length of the filler 13 must be so dimensioned that the outer contour 16 of the filler 13 has a tolerance of no more than ±0.05 mm with respect to the theoretical pitch circle 45 of drive gears driving the cylinder 1. The outer circumference of a bearer ring, and the pitch circle of the drive gears—whichever is used—are shown in broken lines in FIGS. 1 and 3.

The surface of the filler 13, that is, its curved contour 16, thus, may be at the most 0.05 mm below the surface 44 of an associated bearer ring, or the pitch circle 45 of an associated gear; and, at the most, may be 0.05 mm above the surface 44 of a bearer ring or the pitch circle 45 of a gear. Preferably, the contour 16 should match the contour of the bearer ring or the contour of the theoretical pitch circle, respectively. This means, then, that the surface or the contour 16 of the filler should not have the more sharply curved contour of the blanket cylinder 1 which has a slightly smaller diameter.

It has been found that the filler 13 located in the groove 8 of the blanket cylinder 1 and a filler element 13' similarly located in a groove of a further blanket cylinder, and axially in a similar position, provides for effectively damping shocks, vibration and impact upon roll-off of the cylinders over each other, and that such shocks which do arise are of substantially lesser intensity than remanent shocks observed with different covers for the grooves. The print quality, thus, is substantially enhanced.

FIG. 3 shows a further embodiment of the invention on the blanket cylinder 19, the jacket 20 of which has a blanket 21 with a cover layer 22 on a support substrate 23. The blanket 21 is placed about the circumference of the cylinder 19 and stretched thereover. The ends 27, 28 of the blanket 1 are secured in well known manner, not shown, by suitable tensioning spindles. The blanket 21 is pulled over the edges 25, 26 upon clamping. The blanket cylinder 19 is formed at the sides adjacent the opening of the grooves 29 with flattened surfaces 33, 34, and in this manner the embodiment of FIG. 3 differs from that of FIG. 1. The present invention is suitable also with cylinders of this type. In accordance with a feature of the invention, a filler 31 is used which is supported on the bottom wall 30 of the groove in the same manner as described in connection with FIG. 1, and may be similarly attached in the groove. The circular cylindrical contour 32 of the filler 31, again, must not have a tolerance which exceeds ±0.05 mm with respect to the outer circumference 44 of a bearer ring or, with cylinders which do not use bearer rings, with respect to the theoretical pitch circle 45 of the drive gear driving the cylinder.

The filler element 31 which, again, preferably is metallic, may have a damping element 47 interposed between the bottom wall 30 of the groove and the filler element itself, to provide a damped support of the filler element against the groove bottom.

In order to prevent a drop-in of two adjacent cylinders in advance and behind the fillers 30, 31' (see FIG. 3), the the filler 31 has a cross section which is somewhat mushroom shaped, that is, is formed with lateral regions which extend over the flattened portions 33, 34 of the cylinder 19, 19'. This arrangement prevents movement of adjacent cylinders 19, 19' towards each other when the flattened surfaces 33, 34 are reached, which may occur particularly at lower operating speeds.

Customarily, the rubber blanket 3 (FIG. 1) or 21 (FIG. 3) respectively is adjusted such that, considering any underlays, it is positioned 0.04 to b 0.1 mm above the circumference of the bearer rings. Thus, when the machine is stopped, the respective cover layer 5, 22 will be slightly higher than the contour 16, 32 of the respective fillers 13, 13' or 31, 31', respectively. Upon printing, the blankets usually compress somewhat.

Various changes and modifications may be made, and, specifically, the attachment of the filler can be varied substantially. An illustration is FIG. 4, which shows a filler 35 having a shaft 36 which is held on the bottom of the groove (not shown) by two rails 37, 38, secured to the bottom 39 of the groove. One of the rails, for example rail 37, can be secured to the bottom of the groove, for example by screws, welding, or other suitable attachment arrangements; the other rail, as shown rail 38, can be circumferentially or laterally movable, against force of a compression spring 40 which is supported on the side wall 41 of the cylinder groove, shown only schematically. This permits insertion of the filler 35 in simple manner from an axial end, or through the groove opening, and sliding the rail 38 laterally, until it snaps over lateral extension of the filler 35. This is an alternative attachment with respect to the screw connection shown in FIG. 1. The filler 35 is illustrated for use with a cylinder as shown in FIG. 3, and is also mushroom-shaped, in cross section, with laterally extending portions 43, 44 which cover the flattened zones 33, 34 of a cylinder having a flattened region adjacent the groove.

Various other changes and modifications may be made, and features described in connection with any one of the embodiments may be used with any of the others, within the scope of the inventive concept.

A preferred axial length of the filler elements 13, 13', or 31, 31' is about 5 cm (about 2 inches).

I claim:

1. In a printing machine system having a first cylinder having a bearer ring and a cylinder cover, said first cylinder (1, 19) having an axial groove (8, 24) defining groove edges (9, 10; 25, 26) which define the perimeter of the groove, said groove being adapted for retaining said cylinder cover on said cylinder and defining a base, or root, the cylinder being circumferentially supported by the circumference (44) of said bearer ring;

wherein the first cylinder defines three adjacent axial zones of about one-third axial length each and means are provided for improving the running smoothness of said cylinder, comprising a filler element (13, 31), located in the axial groove, said filler element being of lesser axial length than said cylinder, and located only in the center third axial zone of the cylinder (1, 19), said filler element being supported on the base (11, 30) of the groove (8, 24) and being further supported on at least one of the groove edges (9, 10; 25, 26), said filler element having an outer part-circular contour (16, 32) having a radius of curvature which is identical to the radius of curvature (44) of the bearer ring, with a tolerance of not more than about ±0.05 millimeters; and wherein said system further includes a second cylinder (1', 19') having, at least in the region of said filler element of lesser axial length, a cylindrical surface (13, 31') to form a counter surface for said filler element (13, 31).

2. The system of claim 1, wherein said second cylinder has a second bearer ring, a cylinder cover and an axial groove (8, 24) defining groove edges define the perimeter of the groove, said groove being adapted for retaining said cylinder cover thereon and defining a base, or root, the cylinder being circumferentially supported by the circumference of said second bearer ring, and the second cylinder defining three axial zones of about one-third axial length each;

and including a second filler element, located in the axial groove of the second cylinder and providing said cylindrical surface, said second filler element being essentially of the same axial length as said filler element (13, 31) of said first cylinder (1, 19) and positioned essentially in axial alignment with said filler element (13, 31) of said first cylinder (1, 19).

3. The system of claim 1, wherein the cylinder (19) is formed with flattened surfaces (33, 34) laterally of the opening (29) of the groove (19);

and wherein the filler element (31) overlaps and is supported, at least in part, on at least one of said flattened surfaces.

4. The system of claim 3, wherein the filler element is supported on both said flattened surfaces.

5. The system of claim 1, wherein the cylinder is a rubber blanket cylinder; and further including a rubber blanket (3, 21) placed about the rubber blanket cylinder, the rubber blanket having end portions (6, 7; 27, 28) secured in the cylinder groove (8, 24);

and wherein the thickness of the rubber blanket (3, 21) is reduced over the axial length of the filler element (13, 31).

6. The system of claim 5, wherein the rubber blanket has a substrate (4, 23) and a rubber covering (5, 22);

and wherein the reduction in thickness comprises a zone of the rubber covering (5, 22) in the region of the axial length of the filler element (13, 31) where rubber covering material was removed so that the non-removed rubber covering will fit axially against the filler element.

7. The system of claim 5, wherein the rubber blanket comprises a substrate (4, 23) and a rubber covering (5, 22) thereover;

and wherein the reduction in thickness comprises a zone of the rubber blanket in the region of the axial length of the filler element (13, 31) which was removed so that the non-removed portions of the rubber blanket will fit axially against the filler element.

8. The system of claim 1, wherein the filler element (13) is slightly wider than the opening (12) of the groove and is laterally supported on both edges (9, 10) of the groove.

9. The system of claim 1, further comprising a screw connection (14, 15) between the filler element and a bottom wall (11, 30) at the base of the groove.

10. The system of claim 1, wherein the filler element has a holding projection formed thereon; and further comprising a claw holder arrangement (37, 38) retaining the filler element (36) on a bottom wall (39) at the base of the groove, the claw holder arrangement including at least one resiliently supported claw (38) projecting over the holding projection formed on the filler element.

11. The system of claim 1, wherein the filler element (13, 13'; 31, 31', 36) comprises a metal element.

12. The system of claim 1, further including an elastic layer (47) interposed between the filler element and the base, or root (11, 30, 39) of the groove to elastically support the filler element in the cylinder groove.

13. The system of claim 1, wherein the axial length of the filler element is between about 50 mm and 100 mm.

14. The system of claim 1, wherein the axial length of the filler element is about 5 cm.

15. In a printing machine system having a first cylinder having a drive gear and a cover, said first cylinder (1, 19) having an axial groove (8, 24) defining groove edges (9, 10; 25, 26) which define the perimeter of the groove, said groove being adapted for retaining said cylinder cover on said cylinder and defining a base, or root, the cylinder being circumferentially supported by said drive gear, said drive gear defining a theoretical pitch circle (45), wherein the first cylinder defines three adjacent axial zones of about one-third axial length each and means are provided for improving the running smoothness of said cylinder, comprising a filler element (13, 31), located in the axial groove, said filler element being of lesser axial length than said cylinder, and located only in the center third axial zone of the cylinder (1, 19), said filler element being supported on the base (11, 30) of the groove (8, 24) and being further supported on at least one of the groove edges (9, 10; 25, 26), said filler element having an outer part-circular contour (16, 32) having a radius of curvature (44) which is identical to the theoretical pitch circle (45) of the drive gear, with a tolerance of not more than about $\pm 0.05$ millimeters; and wherein said system further includes a second cylinder (1,', 19') having, at least in the region of said lesser axial length, a cylindrical surface (13', 31') to form a counter surface for said filler element (13, 31).

16. The system of claim 15, wherein said second cylinder has a drive gear, a cylinder cover and an axial groove (8, 24) defining groove edges which define the perimeter of the groove, said groove being adapted for retaining said cylinder cover thereon and defining a base, or root, the cylinder being circumferentially supported by said drive gear and the second cylinder defining three axial zones of about one-third axial length each;

and including a second filler element located in the axial groove of the second cylinder, and providing said cylindrical surface, said second filler element being essentially of the same axial length as said filler element (13, 31) of said first cylinder (1, 19) and positioned essentially in axial alignment with said filler element (13, 31) of said first cylinder (1, 19).

17. The system of claim 15, wherein the cylinder (19) is formed with flattened surfaces (33, 34) laterally of the opening (29) of the groove (19);

and wherein the filler element (31) overlaps and is supported, at least in part, on at least one of said flattened surfaces.

18. The system of claim 15, wherein the filler element is supported on both said flattened surfaces.

19. The system of claim 15, wherein the cylinder is a rubber blanket cylinder; and further including a rubber blanket (3, 21) placed about the rubber blanket cylinder, the rubber blanket having end portions (6, 7; 27, 28) secured in the cylinder groove (8, 24);

and wherein the thickness of the rubber blanket (3, 21) is reduced over the axial length of the filler element (13, 31).

20. The system of claim 19, wherein the rubber blanket has a substrate (4, 23) and a rubber covering (5, 22);

and wherein the reduction in thickness comprises a zone of the rubber covering (5, 22) in the region of the axial length of the filler element (13, 31) where rubber covering material was removed so that the non-removed rubber covering will fit axially against the filler element.

21. The system of claim 19, wherein the rubber blanket comprises a substrate (4, 23) and a rubber covering (5, 22) thereover;

and wherein the reduction in thickness comprises a zone of the rubber blanket in the region of the axial length of the filler element (13, 31) which was removed so that the non-removed portions of the rubber blanket will fit axially against the filler element.

22. The system of claim 15, wherein the filler element (13) is slightly wider than the opening (12) of the groove and is laterally supported on both edges (9, 10) of the groove.

23. The system of claim 15, further comprising a screw connection (14, 15) between the filler element and a bottom wall (11, 30) at the base of the groove.

24. The system of claim 15, wherein the filler element has a holding projection formed thereon; and further comprising a claw holder arrangement (37, 38) retaining the filler element (36) on a bottom wall (39) at the base of the groove, the claw holder arrangement including at least one resiliently supported claw (38) projecting over the holding projection formed on the filler element.

25. The system of claim 15, wherein the filler element (13, 13'; 31, 31', 36) comprises a metal element.

26. The system of claim 15, further including an elastic layer (47) interposed between the filler element and the base or root (11, 30, 39) of the groove to elastically support the filler element in the cylinder groove.

27. The system of claim 15, wherein the axial length of the filler element is between about 50 mm and 100 mm.

28. The system of claim 15, wherein the axial length of the filler element is about 5 cm.

* * * * *